US005368444A

United States Patent [19]

Anderson

[11] Patent Number: 5,368,444

[45] Date of Patent: Nov. 29, 1994

[54] ANTI-FRETTING BLADE RETENTION MEANS

[75] Inventor: Bernard J. Anderson, Danvers, Mass.

[73] Assignee: General Electric Company, Cincinnati, Ohio

[21] Appl. No.: 113,133

[22] Filed: Aug. 30, 1993

[51] Int. Cl.[5] ..... F01D 5/32

[52] U.S. Cl. ..... 416/220 R; 416/248

[58] Field of Search ..... 416/219 R, 220 R, 221, 416/248

[56] References Cited

U.S. PATENT DOCUMENTS

| | | | |
|---|---|---|---|
| 2,430,185 | 11/1947 | Prescott | 416/220 R |
| 2,651,494 | 9/1953 | Persson | 416/220 R |
| 2,658,718 | 11/1953 | Walker | 416/220 R |
| 3,014,695 | 12/1961 | Rankin et al. | 416/220 R |
| 3,045,968 | 7/1962 | Willis . | |
| 3,784,320 | 1/1974 | Rossmann et al. . | |
| 3,860,361 | 1/1975 | McMurtry et al. . | |
| 4,820,124 | 4/1989 | Fried . | |
| 5,017,092 | 5/1991 | Violette et al. . | |
| 5,110,262 | 5/1992 | Evans . | |
| 5,141,401 | 8/1992 | Juenger et al. . | |
| 5,160,243 | 11/1992 | Herzner et al. . | |

FOREIGN PATENT DOCUMENTS

| | | | |
|---|---|---|---|
| 989042 | 9/1951 | France | 416/219 R |
| 83607 | 5/1982 | Japan | 416/220 R |
| 226202 | 12/1984 | Japan | 416/219 R |

OTHER PUBLICATIONS

Colwell, A. T., and Cummings, R. E., "10 Ways To Attach Blades", Feb. 1948, pp. 32–35.

*Fretting Wear*, B. G. Brady; SE Technical Paper Series #901786; Aerospace Technology Conference and Exposition, Long Beach, Calif., Oct. 1–4, 1990; pp. 1–17.

*Friction and Lubrication*, F. P. Bowden and D. Tabor; Methuen & Co. Ltd., 1967 pp. 84–91.

*Primary Examiner*—Edward K. Look

*Assistant Examiner*—James A. Larson

*Attorney, Agent, or Firm*—Jerome C. Squillaro; Nathan D. Herkamp; C. W. Stamos

[57] ABSTRACT

Pairs of cylindrical rolling pin elements are disposed in mating nests between blade dovetails and disk posts in a gas turbine engine rotor assembly. During periods of change of disk rim elastic strain caused by changes in rotor speed, relative movement between the blade dovetails and disk posts is afforded through rolling contact of the pin elements. High pressure load slippage between conventional pressure face portions of dovetails and posts and resultant fretting wear damage is obviated. Multiple pairs of pins and nests and pins of other than cylindrical geometry are also contemplated.

11 Claims, 4 Drawing Sheets

ANTI-FRETTING BLADE RETENTION MEANS

TECHNICAL FIELD

The present invention relates generally to blade retention scheme in gas turbine engines and more specifically to an improved configuration rotor assembly employing rolling elements between the blade dovetails and disk posts to prevent fretting.

BACKGROUND OF THE INVENTION

In conventional gas turbine engine rotor assemblies, a plurality of aerodynamically shaped blade airfoils are disposed in the flowpath to react with the working fluid of the engine. For example, in a turbofan engine, air passing through the inlet cowling is compressed initially in a multistage fan or low pressure compressor (LPC). A large portion of the air is channeled aft through a duct, bypassing the core engine flowpath. The remainder of the compressed air passes through a multistage high pressure compressor (HPC) where it is further compressed before being mixed with fuel and ignited in the combustion section of the engine. The hot gases subsequently pass through a high pressure turbine (HPT), which is operably connected to the HPC by a shaft, where energy is extracted to drive the HPC. The flow is then directed through a low pressure turbine (LPT), which is operably connected to the LPC by a second shaft, where additional energy is extracted to drive the LPC. The flow is then combined with the bypass flow and exhausted through a nozzle, to provide propulsive thrust to an airframe.

In one conventional style of axial fan and compressor rotor, each stage is comprised of a plurality of removable blades, typically retained in the rim of a rotor disk by means of convoluted blade dovetails and complementary shaped axial slots formed between adjacent disk posts. The interlocking dovetail and slot contours are precisely configured and machined to ensure proper fit and retention of the blades under very high disk rotational speeds and induced centrifugal and aerodynamic loads. Further, the load path through the blade dovetail into the disk must be carefully controlled so as to prevent detrimental vibratory modes as well as avoid excessive component stresses. Failures which occur at the dovetail/disk interface can result in release of the blades from the disk at high rotational speeds resulting in significant secondary damage to the engine.

A fundamental problem associated with gas turbine rotors of this design is the detrimental effect of high pressure cyclic loading through the dovetail and disk post interfaces, commonly referred to as pressure faces. During periods of change in rotor speed such as runup and coastdown, changes in disk rim elastic strain result in relative movement and slippage between the dovetail and disk posts along the pressure faces. This sliding action damages the surfaces by introducing microcracks, prime initiation sites for fatigue cracks, which propagate under the combined effect of high cycle vibration and recurring stress cycling. This condition, commonly referred to as fretting, results in a significant reduction in component fatigue life. Titanium alloys, which are used extensively in modern gas turbine fan and compressor rotor stages due in part to exceptional strength to weight ratios, have been shown to be particularly susceptible to fretting damage, visually apparent as localized zones of surface discoloration. Fretting is most apparent when both the blades and disks are comprised of titanium alloy. In practice, reduction in component fatigue strength of up to 75% and related shortening of component life is common. Fretting tends to be more pronounced in front end blading of fan and compressor rotors, where relative slippage and blade loads are greatest. Integrally bladed disks, commonly referred to as blisks, are sometimes employed in these locations; however, since front end stages are most susceptible to ingested foreign object damage, replaceable blading is desirable for economic considerations. While titanium exhibits particular susceptibility to fretting damage, other conventional steel and nickel based alloys employed in rotors can exhibit similar distress.

Attempts have been made, both in the design and manufacture of rotor disks and blades by those skilled in the art, to either delay the onset of fretting damage or minimize its effect. For example, pressure face contact angle is predetermined to control the amount of relative slippage and the magnitude and direction of the transmitted load. Also, during manufacture, after being ground to precise contour and dimensions, blade dovetails may be shotpeened. While providing compressive surface stresses which make the dovetail pressure face surface less susceptible to microcracking, shotpeening increases average surface roughness to the range of 32 microinches rms or greater, thereby increasing resultant sliding friction. Similarly, disk dovetail slots may be shotpeened after being broached, although this procedure is more difficult and more variable due to limited accessibility. To provide additional margin against the initiation of fretting damage, protective alloy wear coatings such as thin sacrificial layers of copper, nickel and indium, in the range of several mils of thickness, are routinely applied to blade dovetails. Further, lubricants such as molybdenum disulfide are applied to the pressure faces to reduce friction; however, their effectiveness is short lived and periodic reapplication is necessary, costly and inconvenient. These coatings and lubricants can also be employed in cooperation with shim elements located between the dovetails and the disk posts. Also, dovetails slot contours can be modified by undercutting the disk posts to remove material subject to peak surface stresses. While actions such as these are helpful in delaying the onset of fretting, they fail to address the inherent problem of high cycle, high pressure induced sliding damage. With time, relative movement degrades the treated contact surfaces until the dovetail and/or the disk post suffer irreparable fretting damage and fatigue cracking at which point they must be removed from service. Due to the significant secondary damage caused by rotor component failures, the risk associated with operating potentially damaged components is typically unwarranted; therefore, frequent stripping, inspection, and recoating of blade dovetails and ultimately removal and replacement of nondiscrepant components at considerable inconvenience and cost is often required.

SUMMARY OF THE INVENTION

According to the invention, a stage of a bladed rotor assembly comprises a disk having a plurality of dovetail slots in the rim bounded by disk posts. A common number of complementarily shaped blade dovetails are disposed in the slots. Rolling element pins are retained in nesting features in the load paths between adjacent dovetails and disk posts to provide rolling rather than sliding contact between proximate elements during periods of change of disk rim elastic strain caused by changes in rotor rotational speed. Pin and nest geometries are precisely manufactured to ensure acceptable stress levels and proper load transmission. Blade retainers mounted to the axial faces of the disk may include special features to cooperate with pin ends in applications with axial or skewed dovetail slots.

BRIEF DESCRIPTION OF DRAWINGS

The novel features believed characteristic of the invention are set forth and differentiated in the claims. The invention, in accordance with preferred and exemplary embodiments, together with further objects and advantages thereof, is more particularly described in the following detailed description taken in conjunction with the accompanying drawings in which:

MODE(S) FOR CARRYING OUT THE INVENTION

Figure 1:
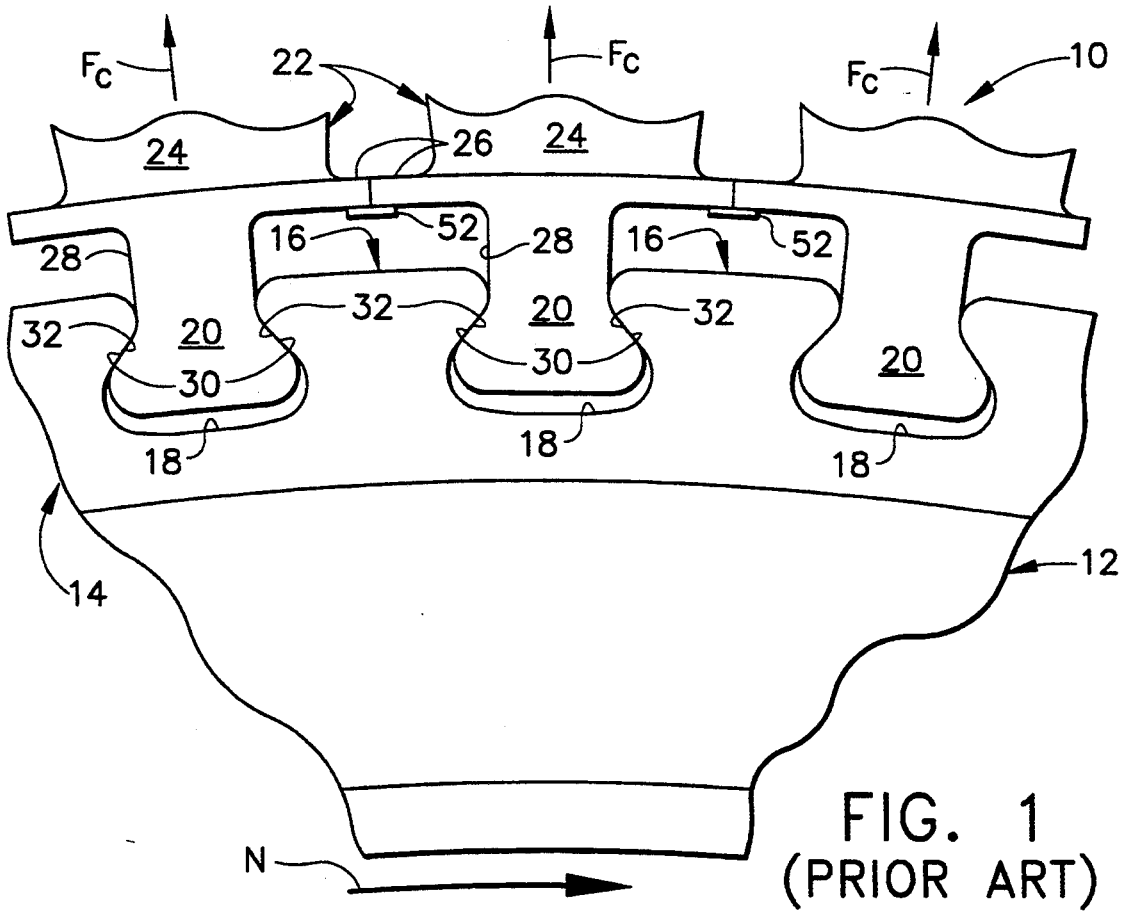
FIG. 1 (PRIOR ART)
FIG. 1 is a schematic, longitudinal view of a portion of a conventional prior art bladed rotor stage.

Shown in FIG. 1 is a portion of a conventional stage of a rotor 10 of a gas turbine engine, comprising a disk 12 with a rim portion 14 composed of a plurality of disk posts 16, forming therebetween a common number of dovetail slots 18. The slots 18 are geometrically configured to receive in close fitting relation the dovetail portions 20 of a common number of rotor blades 22, each blade 22 further comprising an airfoil portion 24, a platform 26 and neck 28. A single tang dovetail 20 is shown here for clarity of illustration; however, multiple tang dovetail members are common in the art and also benefit from the teachings of this invention. During engine operation, the rotor 10 spins about its axis of rotation at varying rotational speed N. Rotationally induced centrifugal forces on the blades 22 and aerodynamic loading on the airfoils 24 are transmitted through the dovetails 20 and into the disk posts 16 across mating dovetail pressure faces 30 and disk post pressure faces 32. As the disk 12 is accelerated from rest or decelerated from a given rotational speed N, changes in mechanical growth in the disk, as evidenced by changes in elastic strain in the rim 14 cause relative motion between the pressure faces 30, 32. For example, during acceleration of the rotor 10, the disk posts 16 separate slightly, allowing the dovetail slots 18 to widen, permitting the blades 22 to slide radially outwardly due to the net centrifugal force, $F_C$, acting on the blades 22. Depending on the configuration of the rotor 10 and change in speed N, relative slippage along faces 30, 32 can be in the range of 0.003 inch to 0.012 inch or more. The closer to radial the angle of the plane of contact of the pressure faces 30, 32, also known as the contact angle, the greater the slippage.

Figure 2:
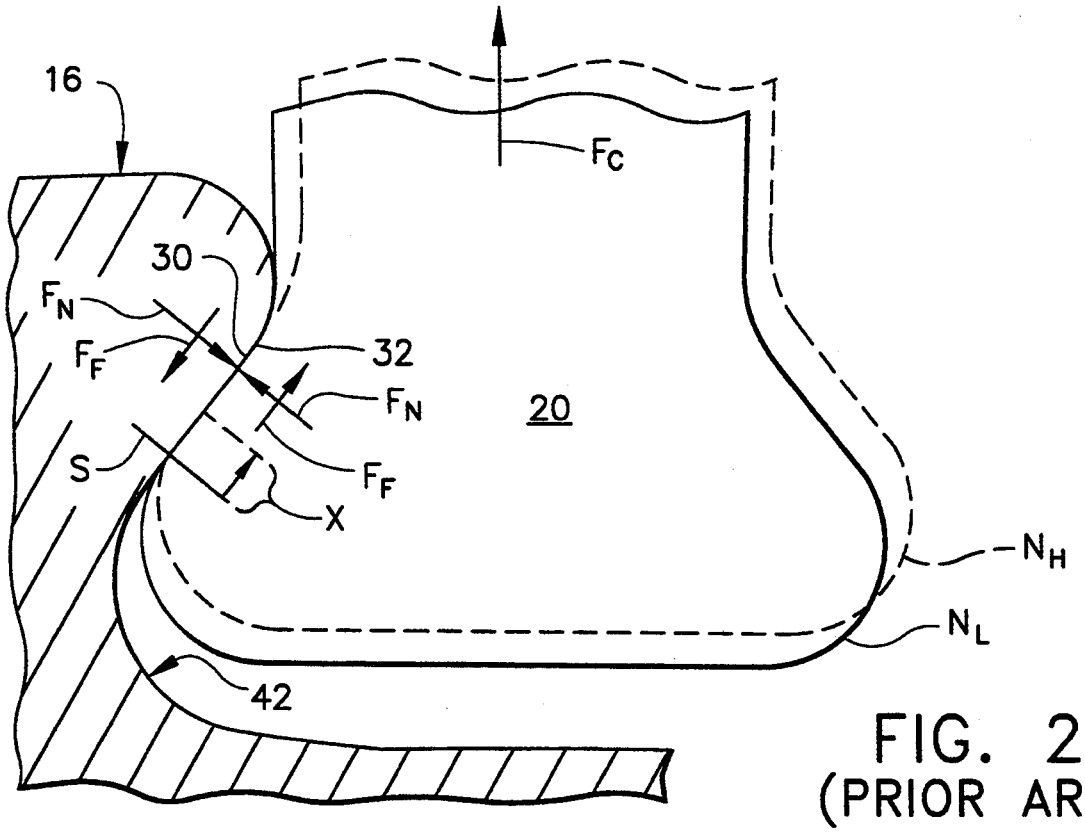
FIG. 2 (PRIOR ART)
FIG. 2 is an enlarged view of a dovetail/disk post interface depicted in FIG. 1 at varying operational conditions.

The position of the dovetail 20 relative to an adjacent disk post 16 for two different speed conditions is shown in more detail in FIG. 2, the magnitude of the displacement being exaggerated for illustrative purposes. At a low speed $N_L$ sufficient to maintain contact between pressure faces 30, 32 during rotor rotation, relative component location is depicted in solid and marked with a match line S across faces 30, 32. At some higher rotational speed $N_H$, depicted in broken line, the blade 20 has migrated radially outwardly relative to the post 16 a distance X as measured along the pressure faces 30, 32. The distance X is dependent on a variety of factors, including net change in speed, number and size of blades, and contact angle. While only one pest 16 is shown here for clarity, this interaction is occurring substantially uniformly on beth blade pressure faces 30 and between all blades dovetails 20 and posts 16 in the rotor 10.

Combined centrifugal and aerodynamic loads are transmitted as paired normal force components, $F_N$, across the contact area between the pressure faces 30, 32. This force results in a pressure distribution which is commonly referred to as the crush load. In the interface, there is also a friction induced shear force pair, $F_F$, acting in the orthogonal direction, parallel to the pressure faces 30, 32. While the force balance is depicted here in a highly simplified manner, the theoretical stress distribution in the interface is much more complex. For example, irregularities such as variation from true flatness and parallelism of pressure faces 30, 32 produce nonuniform local stress zones. Further, as taught by Juenger et al in U.S. Pat. No. 5,141,401: Stress-Relieved Rotor Blade Attachment Slot, assigned to the assignee of the present invention and herein incorporated by reference, very high edge of contact stresses occur in the disk post 16 and dovetail 20 at the pressure face contact fringes. These extreme stress levels cause localized plastic deformation of material on a microscopic level. During engine operation, cyclic migration of these elevated stress zones repeatedly yield the material until surface degradation advances to development of surface cracking and fretting damage. Yet further, during periods of deceleration, a hysteretic effect may occur whereby the crush load and associated stress on the pressure faces 30, 32 can increase to levels in the range of 130% to 140% that encountered under steady state high speed operation. In the course of relaxation of the elastic strain in the rim 14 during coastdown, as the disk posts 16 squeeze dovetails 20, they wedge until the component of the crush load in the plane of the pressure faces 30, 32 overcomes static friction along the pressure faces 30, 32 and slippage occurs. In some designs with large contact angles approaching radial, for example 75° or greater, the dovetails 20 can permanently wedge and lock between the posts 16, the component restoring load along the pressure faces 30, 32 induced by the decrease in elastic rim strain being insufficient to overcome static friction.

Figure 3:
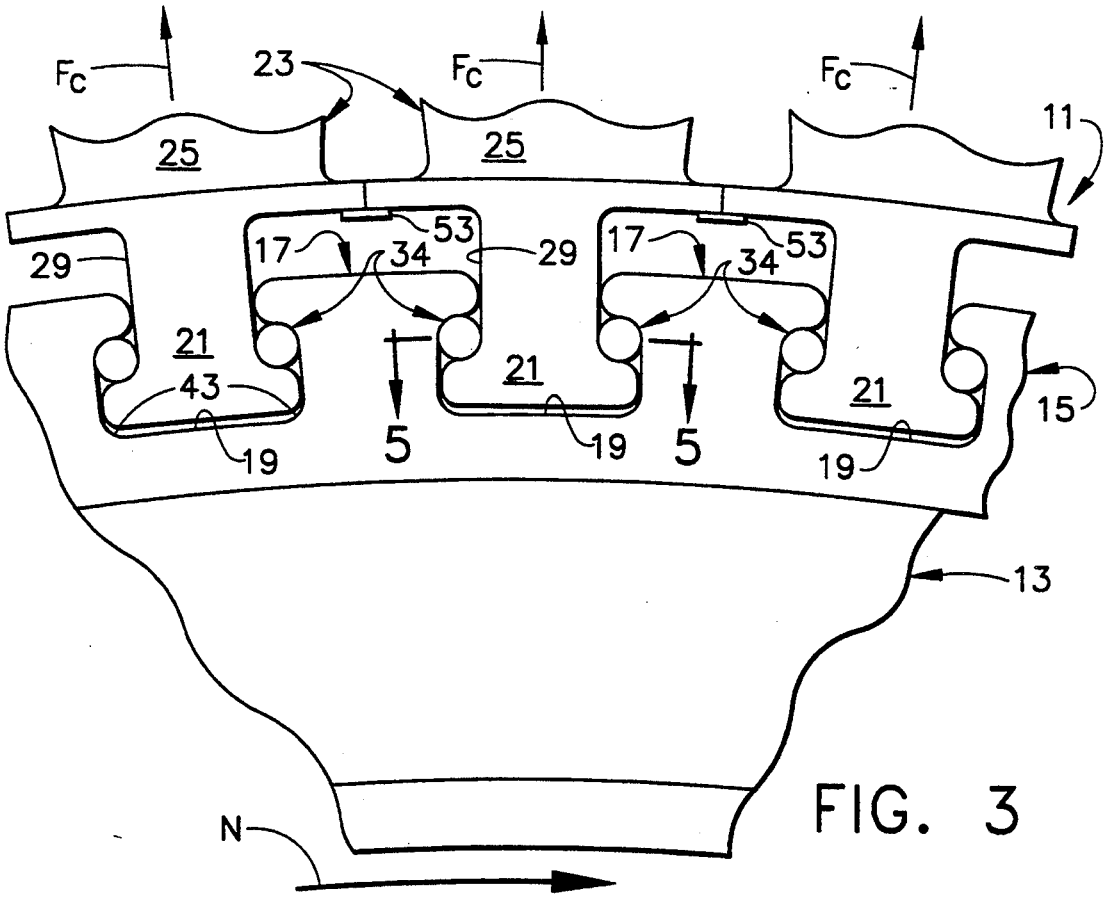
FIG. 3 is a schematic, longitudinal view of a portion of a bladed rotor stage in accordance with the present invention.
Figure 4:
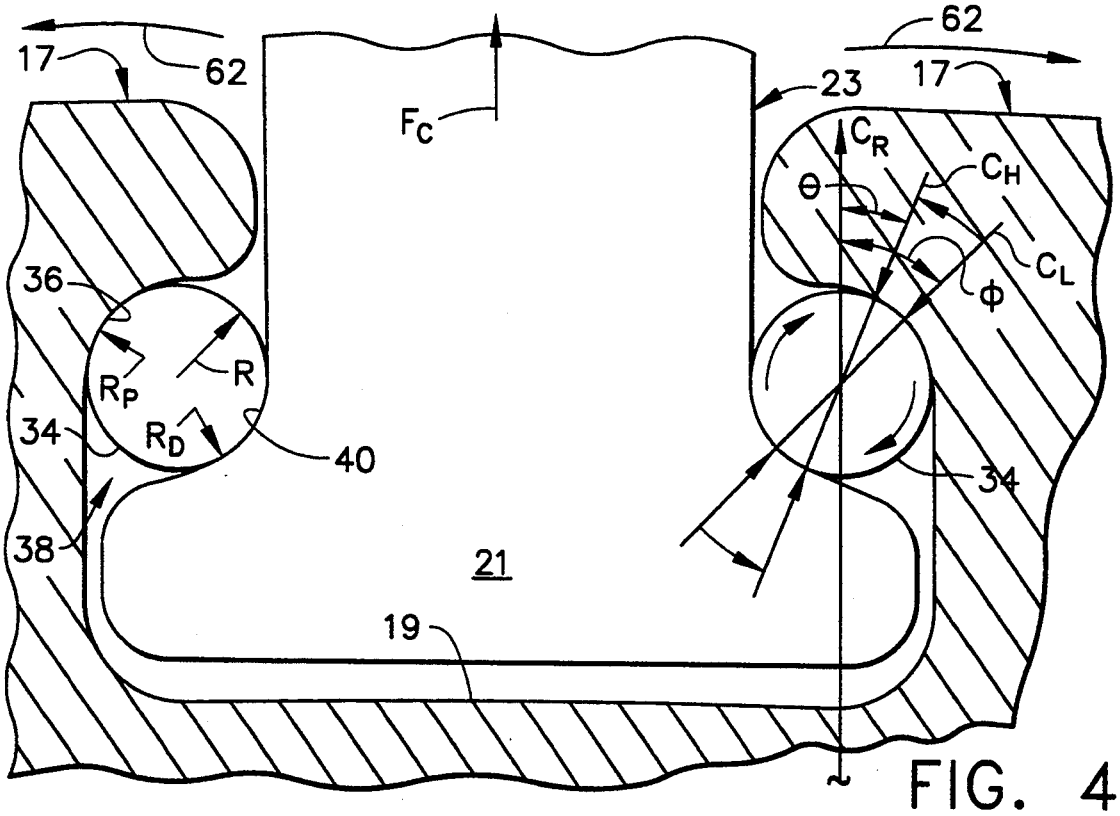
FIG. 4 is an enlarged view of a dovetail/disk post interface zone of the invention depicted in FIG. 3 at varying operational conditions.

According to the teachings of the present invention, these numerous shortcomings of conventional blade retention schemes are altogether avoided. FIG. 3 depicts an improved stage of a rotor 11, comprising disk 13 with rim portion 15 and blades 23. A plurality of rolling element pins 34 are disposed in dovetail slots 19 between disk pests 17 and dovetails 21. The load path, which formerly passed directly through pressure faces 30, 32, now passes from dovetails 21 into disk posts 17 diametrically through the intermediate pins 34. The interface between dovetails 21, pins 34 and posts 17 is advantageously configured so that during periods of rotor acceleration and deceleration, relative movement between posts 17 and dovetails 21 occurs through the rolling action of the pins 34, obviating high crush load slippage and edge of contact stress of prior art designs. More specifically, as shown in FIG. 4, each pin 34 is disposed in a geometrically configured nest 38 comprising first curved post surface 36 and second curved dovetail surface 40. The nest 38 may be advantageously configured to substantially match the external geometry or contour of the pin 34, typically cylindrical, although other configurations may be desirable, as will be discussed hereinbelow. Further, the axial length of the nest 38 typically extends across the entire width of the disk. In order to allow for rolling of the cylindrical pin 34 during relative movement between dovetail 21 and post 17, the radius of curvature or arcuate contour of post and dovetail surfaces 36, 40, respectively, must be slightly greater than that of the pin 34. For example, for a pin radius R, post nest internal radius $R_P$ and dovetail nest internal radius $R_D$ may be up to ten percent greater than R, with lesser values around five percent being generally preferred in order to minimize contact stresses; however, the sizes and tolerances of the machined features should be readily manufacturable without requiring special costly steps or extraordinary diligence. Nominal nest radii $R_P$, $R_D$ of around 105% of R, or greater, are conventionally achievable. Further, an oversize condition where the diameter of the pin 34 is larger than that of the nest 38 would prevent rolling and therefore be undesirable. Sizing of the radii of the pin 34 and nest 38 is based on such factors as the anticipated operational loads, manufacturing process capability and the materials of the pin 34, dovetail 21 and disk post 17. The elements are designed to withstand the anticipated maximum contact stress in the nest 38 with some acceptable level of margin. Conventional design practice, for example, may set as a limit a stress level which induces a very small, finite percentage of plastic strain in the materials used, for example in the range of 0.02% to 0.2%. Further, the arcuate length and angular orientation of respective curved post and dovetail seating surfaces 36, 40 with respect to a radial plane $C_R$ of the disk 13 is predetermined and controlled within the space available to ensure sufficient rolling contact surface length as well as acceptable contact load plane orientation for all rotor speeds N. Contact load plane is the term ascribed to the plane defined by the idealized contact lines between the pin 34 and each of the first curved post surface 36 and the second curved dovetail surface 40 as will be more thoroughly described hereinbelow.

In a preferred embodiment depicted in FIGS. 3 and 4, the nominal low speed contact plane $C_L$ corresponding to low rotor speed $N_L$ forms an included angle phi, $\phi$, with a radial plane $C_R$ of the disk 13 and is typically set in the angular range of 30° to 60° from radial, having a nominal value of approximately 45°. As the rotor 11 accelerates to some higher rotational speed $N_H$, posts 17 spread circumferentially, widening the dovetail slot 19 as shown by the arrows 62, allowing the blade 23 to move radially outwardly under the influence of the net centrifugal force $F_C$. As pin 34, shown on the right side of the dovetail 21 in this depiction, rotates in a clockwise direction, the contact load plane migrates to a more radial orientation angle theta, $\theta$, corresponding to a higher speed contact plane $C_H$. The contour of the nest 38 is configured so that this included angle theta, $\theta$, is typically set in the angular range of 5° to 45° from radial, having a nominal value of approximately 25°. During periods of operation at intermediate rotor speeds, the angle of the contact load plane varies smoothly therebetween. In summary then, typical nominal contact planes comprise angular orientation between about 25° and about 45° from radial, having an included arcuate length of about 20°. Typical extreme contact planes comprise angular orientation between about 5° and about 60° from radial, having an included arcuate length of about 55°. These arcuate lengths and angular orientations have been selected to provide acceptable stress distributions in disk posts 17 and dovetails 21 which are readily manufacturable to the desired contour and tolerance; however, the desired load transfer and stress distribution requirements for a particular application may warrant use of other lengths and orientations.

It should be noted that the representation of load transfer from the dovetail 21 through the pin 34 into the post 17 along a discrete contact plane is a highly simplified case of the extant condition. Hertzian theory, as is conventionally applied to the analysis of rolling element bearings transmitting high loads, teaches that localized elastic deformation occurs in the cylindrical rolling element as well as in the bearing surfaces in the immediate vicinity of the transmitted load along the line of action. This deformation increases the effective area over which the load is distributed. For example, in a highly loaded cylindrical element such as pin 34, this deformation zone may extend in the range of 30° to 35° of arc. The maximum loading of the elements in the load plane must nevertheless be adequately modeled or determined by empirical methods to prevent operation under excessive stresses. It should be noted that the average stresses experienced by the components of this invention are typically greater than those associated with prior art designs incorporating relatively large sliding contact area pressure faces 30, 32, perhaps on the order of double. In general, though, the stress is essentially uniformly compressive and is well within the acceptable stress range for typical materials utilized at this location. For example, loads transmitted across the pin 34 may induce stresses in the nest 38 on the order of 140,000 pounds per square inch (140 ksi) in a fan stage of a typical turbofan engine. While this may be double the 70 ksi average stress induced in a conventional sliding pressure face arrangement as depicted in FIGS. 1 and 2 for such an engine, the level is acceptable as the contact surfaces are loaded in compression and free of relative slippage. Without slippage and the associated frictional shear and tensile edge of contact stresses, detrimental surface deformation is neither initiated nor propagated. Life limiting areas for the improved rotor 11 are dovetail slot bottom edges 43 in the minimum neck regions of the posts 17 and the minimum area regions of the blade necks 29 which are subject to cyclic tensile loading, similar to corresponding locations in a conventional stage of a rotor 10.

As stated hereinbefore, the requirement for pin rolling allowance in the nest 38 should be balanced with the requirement to maintain acceptable maximum stress levels. As used here, the term allowance is defined as the sum of the difference between the pin radius R and the nest radii $R_D$, $R_P$. A finite amount of allowance is required in the nest 38 to permit the pin 34 to roll; however, the allowance must not be so great that the local stress field substantially exceeds the elastic limits of the materials used, resulting in plastic deformation and permanent material flow in the contact zone. If, however, some small degree of plastic deformation were to occur under excessive loading conditions, due for example to high temperature rapid rotor excursions outside the normal operating range of the gas turbine engine, it is desirable that the nest 38 yield before the pin 34. In this manner, the contour of the nest 38 would be modified slightly in a benign manner, reducing the effective peak stresses in a localized region without producing a local flat on the pin 34. Such a result could be predetermined simply by appropriate material selection. For example, in a preferred embodiment, the blades 23 and disk 13 could be manufactured of conventional titanium alloy and the pins 34 of a substantially harder nickel based alloy, thereby ensuring preferential yielding of the nest 38.

As can be appreciated by those having skill in the art, relatively large contact plane angle changes occur for small amounts of rotation of pin 34. For example, for a pin 34 having a nominal radius R equal to 0.048 inch, seated in a preferentially sized nest 38 having common dovetail and post nest radii $R_D$, $R_P$ equal to 106% of that value or 0.051 inch, circumferential spreading of posts 17 due to rotor acceleration of approximately 0.005 inch will induce pin roll of only between one and two degrees. The line of action of the blade load through pin 34 however, rotates through a much larger angle, in the range of 15° to 25°. Due to this sensitivity and the need to maintain the load plane in the nest 38 within predetermined angular limits, pin radius R should be controlled to tight tolerance, for example by being centerless ground to within ±0.0001 inch of the nominal diameter. This method of manufacture also advantageously produces a fine surface finish, for example in the range of 8 microinches rms, which facilitates rolling.

As stated hereinbefore, lubricants and wear coatings are routinely applied to pressure faces 30, 32 in conventional applications. Their use in cooperation with the teachings of this invention is typically neither warranted nor desirable. Not only would such coatings produce a toughened surface on the pin 34 and within the nest 38, they may also be of variable applied thickness and may exhibit limited performance properties at the high pressures encountered between the pin 34 and the nest 38 along the load plane. For example, local deformation and extrusion of the coatings could adversely effect the smooth operation of the invention. For certain lower load range applications, however, the application of such surface treatments may be warranted and their use is certainly not precluded by the teachings of the invention. In general, however, the use of precision ground uncoated pins 34 in precision nests 38 manufactured by conventionally machining and shotpeening disk posts 17 and dovetails 21 alone is sufficient to achieve the performance improvement cited herein. The detail design of the disk 13, dovetail slot 19, dovetail 21 and blade 23 are developed using conventional techniques to accommodate the full variety of load directions, locations and magnitudes that can occur across the entire speed range, as well as machining tolerances inherent in manufacture of the pin 34 and nest 38. Dovetail and pest nest radii $R_D$, $R_P$ may have equivalent or different values depending on the requirements of the particular application and materials utilized.

Figure 5:
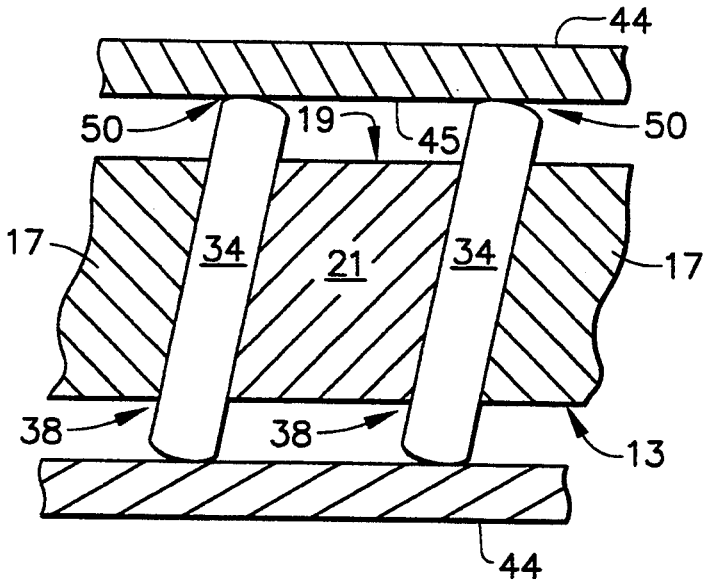
FIG. 5 is a schematic sectional view of a portion of the rotor shown in FIG. 3 taken along line 5—5.
Figure 5A:
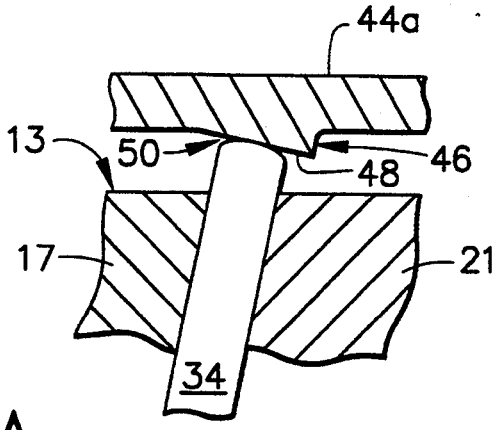
FIG. 5A is an alternate embodiment of the invention depicted in FIG. 5.
Figure 5B:
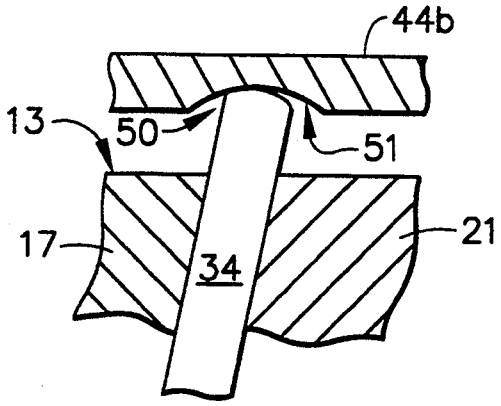
FIG. 5B is yet another alternate embodiment of the invention depicted in FIG. 5.

In conventional bladed disk applications comprising axial or near axial dovetail slots 19, pins 34 are retained in the nests 38 by the combined action of dovetail and pest nest radii $R_D$, $R_P$ and blade retainers 44 conventionally attached to the faces of disk 13 or otherwise, as shown in FIG. 5. For those applications employing dovetail slots 19 skewed, for example, up to about 15° relative to the axis of rotation of the engine, typical of aft fan and compressor stages due to general alignment of the dovetail 21 with the mean chord of the airfoil 25, additional features may be incorporated in the blade retainers 44 to prevent migration of the pins 34 from the nests 38. Although blade twist and friction cooperate to retain the pins 34, migration may occur, for example, due to net axial translation or "walking" of the pins 34 out of the nests 38 as a result of rotor speed cycling. A preferred means for addressing this issue is shown which depicts the cooperation of the pins 34, dovetail 21 and adjacent disk pests 17 with retainers 44. Rounded or arcuate pin ends 50 may bear directly on a radial face 45 of the retainer 44 as shown in FIG. 5. Alternatively, protrusions 46 comprising faces 48 generally normal to the axis of the pins 34 could be incorporated as part of retainer **44*a* or other member in the rotor 11 to cooperate with rounded pin ends 50 as shown in FIG. 5A. FIG. 5B shows yet another embodiment wherein rounded pin ends 50 are disposed in mating contoured recesses or depressions 51 of retainer 44*b*. Naturally, other arrangements can be accommodated depending on the particular rotor assembly, including pin ends 50 of differing shape with mating protrusions 46 or depressions 51 in retainers 44 or other rotor components. Any additional anticipated loading of the retainers 44 by the pins 34** is conventionally accounted for in the design of the retainer attachment means similar to treatment of net axial blade loads. It is contemplated that in highly loaded rotor stages comprising skew dovetail slots of 20° or greater, elastic deformation and twisting of the disk pests during operation may cause undesirable frictional slippage of the pin in the nest and coincident surface distress.

Beyond the elimination of fretting damage to dovetails 21 and disk posts 17 afforded by this invention, other advantages result from the application of the inventive concepts disclosed herein. For example, in the turbomachinery arts in conventional arrangements, vibrations in the airfoil portion 24 of the blade 22 are of fundamental concern in the design of rotor stages 10. In order to control the excitation of detrimental vibratory resonances in the blades 22, dampers 52 of various configuration and location are often incorporated in the rotor 10, for example beneath the blade platforms 26 as depicted schematically in FIG. 1. Energy input into the airfoil portion 24 due to aerodynamic excitation forces is dissipated by relative movement between the blade platforms 26 and the dampers 52 in this example. The use of conventional damping schemes, such as blade platform dampers 53 shown schematically in FIG. 3, in combination with the instant invention would result in significant improvement in damping characteristics, due in part to the additional freedom of blade motion afforded by the rolling action of the pins 34, as opposed to the more restrictive sliding action inherent with conventional designs incorporating pressure faces 30, 32. Damping may occur at lower levels of vibration in the airfoils 25 which heretofore would have been insufficient to overcome the frictional shear forces required to induce movement at the damper/platform interface. Similarly, during periods of high levels of airfoil excitation, as may occur during rotor speed transients through blade resonance conditions, detrimental vibratory effects may be more readily attenuated.

Figure 6:
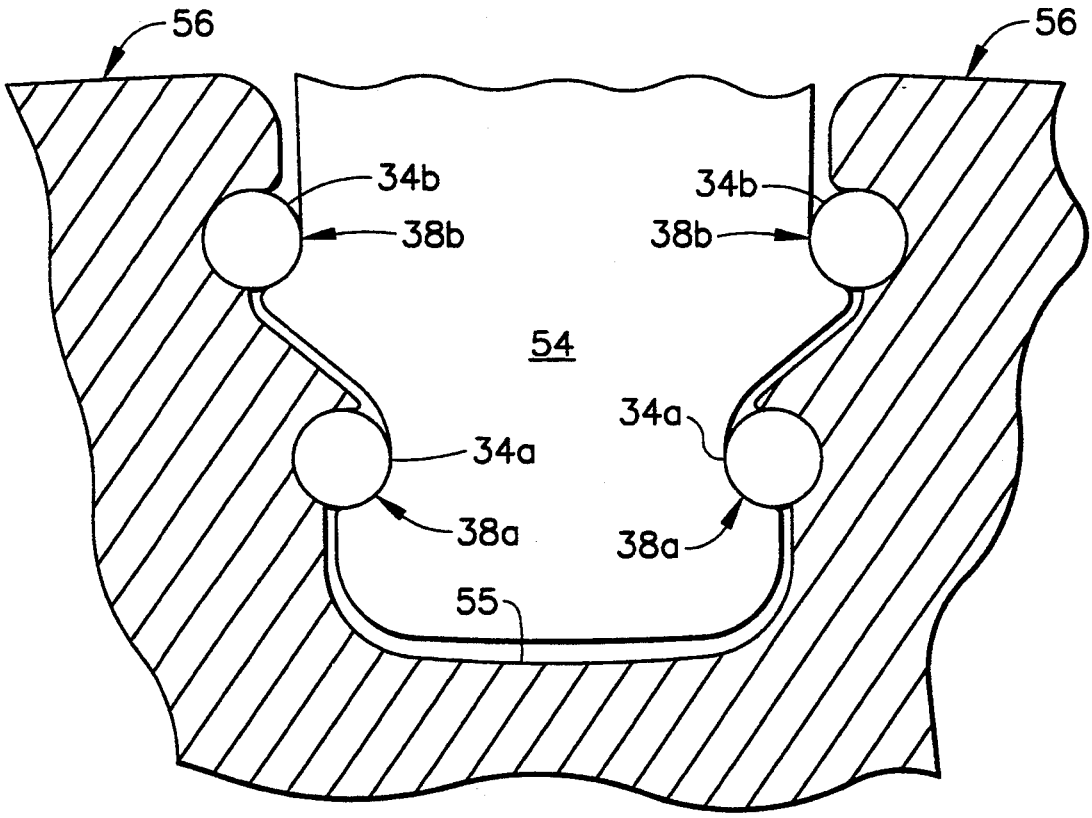
FIG. 6 is an enlarged schematic view of a dovetail/-disk post interface zone in accordance with an alternate embodiment of the invention.
Figure 7:
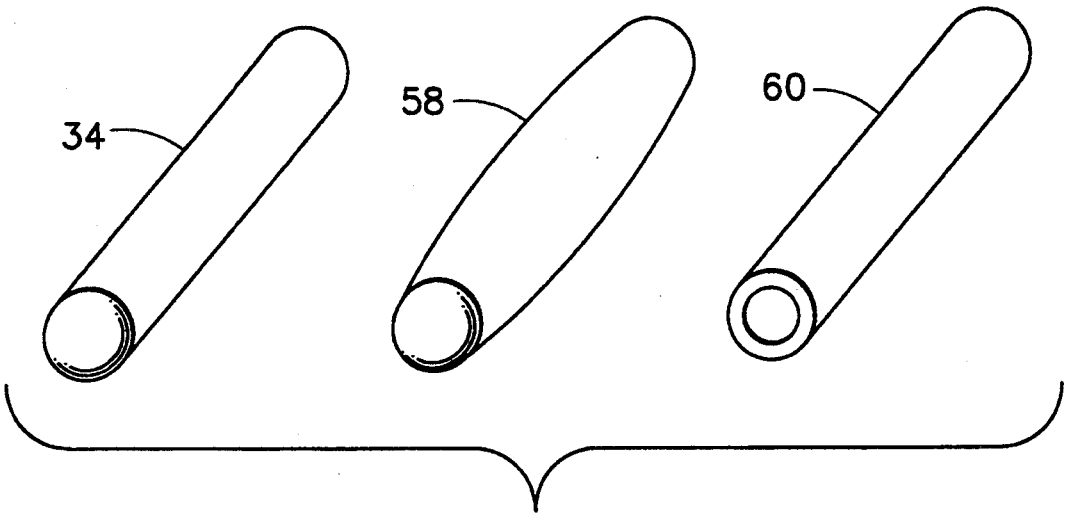
FIG. 7 is a schematic perspective view of several modified forms of one element of the invention.

While various preferred embodiments have been disclosed herein, the innovative concepts of this invention find application in a broad variety of rotors. For example, FIG. 3 depicts blades with single tang dovetails 21 incorporating a pair of pins 34. FIG. 6 depicts a multiple tang dovetail 54 in a complementarily shaped dovetail slot 55 formed by disk posts 56, here shown accommodating a plurality of pin pairs. The pins may be radially and circumferentially in line or offset, depending on the particular application. The nest allowances, locations and orientations may be predetermined so that all pairs act simultaneously in concert, or effective loading through the pairs may be staged as a function of increasing rotor speed. For example, the radially innermost pair of pins **34*a* disposed in first nests 38*a* may be loaded first at low speed whereas radially outer pairs 34*b* disposed in second nests 38*b* become loaded successively as rotor speed increases. Also, as shown in FIG. 7, the pin 34 is depicted as a solid cylindrical member, having a circular radial contour and linear axial contour, although here too, other configurations are contemplated including those having radii which vary as a function of axial length, such as a noncylindrical crowned pin 58, having a circular radial contour and arcuate axial contour. Further, pins of any configuration may be disposed in either cylindrical or complementarily shaped nests. Such configurations may be advantageously applied to a rotor 11 where additional control of the magnitude and location of load transmitted into the disk 13 is required. For example, a slightly crowned pin 58 may be disposed in a cylindrical nest 38 to concentrate loading in a medial plane of the disk 13. The invention is also applicable to rotor stages comprising sloped dovetail slots, having a changing radial dimension as a function of axial length. Here again, blade retainers 44 or other rotor elements could incorporate features to axially locate the pins 34 in the nests 38. While significant benefit is afforded in the LPC and HPC rotors as mentioned hereinbefore, the teachings of this invention are also applicable to bladed stages in the HPT and LPT where conventional LPC and HPC wear coatings and lubricants cannot be used due to the high temperatures encountered at these locations. For these applications, hollow pins 60 comprising an annular shell could be employed to afford passage of cooling airflow. Hollow pins 60 of any external configuration could also be employed in any rotor stage 11 where light weight is desired and may also be used advantageously to reduce stress in the nest 38 relative to a solid pin 34 as a hollow pin 60** may more readily elastically deform, spreading the transmitted load over a greater contact area.

While there have been described herein what are considered to be preferred embodiments of the present invention, other modifications of the invention will be apparent to those skilled in the art from the teachings herein, and it is therefore desired to be secured in the appended claims all such modifications as fall within the true spirit and scope of the invention.

Accordingly, what is desired to be secured by Letters Patent of the United States is the invention as defined and differentiated in the following claims:

I claim:

1. A rotor blade retention apparatus comprising:

a rotatable disk having a plurality of disk posts in a rim portion thereof forming a common number of dovetail slots therebetween;

a plurality of blades having generally complementarily shaped dovetails disposed in said dovetail slots; and rolling contact means disposed in said slots between said dovetails and said disk posts for providing rolling contact therebetween, said rolling contact means comprising:

at least one generally cylindrical pin having a constant pin radius R along an axial length thereof, disposed in a nest complementarily geometrically configured to retain said pin, wherein said nest comprises:

a first curved seating surface of said post having an arcuate contour comprising a first radius of curvature $R_P$ and a first predetermined axial length, arcuate length and angular orientation; and a second curved seating surface of said dovetail having an arcuate contour comprising a second radius of curvature $R_D$ and a second predetermined axial length, arcuate length and angular orientation such that said radii of curvature $R_P$, $R_D$, of said first and second respective seating surfaces have values greater than said pin radius R.

2. The invention according to claim 1 wherein:

said radii of curvature $R_P$, $R_D$, of said first and second respective seating surfaces have substantially equivalent, constant values which are less than about 110% of said pin radius R.

3. The invention according to claim 1 wherein:

said first curved seating surface of said post comprises a minimum arcuate length of about twenty degrees angularly oriented between about twenty-five degrees and about forty-five degrees from a radius of said disk which passes through a point of origin of said first radius of curvature $R_P$; and said second curved seating surface of said dovetail comprises a minimum arcuate length of about twenty degrees angularly oriented between about one hundred and thirty-five degrees and about one hundred and fifty-five degrees from a radius of said disk which passes through a point of origin of said second radius of curvature $R_D$.

4. The invention according to claim 1 wherein:

said first curved seating surface of said post comprises a minimum arcuate length of about fifty-five degrees angularly oriented between about five degrees and about sixty degrees from a radius of said disk which passes through a point of origin of said first radius of curvature $R_P$; and said second curved seating surface of said dovetail comprises a minimum arcuate length of about fifty-five degrees angularly oriented between about one hundred and twenty degrees and about one hundred and seventy-five degrees from a radius of said disk which passes through a point of origin of said second radius of curvature $R_D$.

5. The invention according to claim 1 further comprising a blade retainer attached to a face of said disk to prevent axial migration of said pin from said nest wherein said retainer comprises a face portion abutting a generally arcuate end portion of said pin.

6. The invention according to claim 1 further comprising a second generally cylindrical pin disposed in a second complementarily geometrically configured nest, said second nest being disposed generally radially outwardly from a first pin disposed in a first nest.

7. The invention according to claim 1 wherein said cylindrical pin comprises a hollow annular shell.

8. The invention according to claim 1 wherein said pin is comprised of a harder material than material comprising said first curved seating surface of said post and said second curved seating surface of said dovetail.

9. The invention according to claim 8 wherein said material of said pin is comprised of a nickel based alloy and said material of said first curved seating surface of said post and said second curved seating surface of said dovetail is comprised of a titanium alloy.

10. A rotor blade retention apparatus comprising:

a rotatable disk having a plurality of disk posts in a rim portion thereof forming a common number of dovetail slots therebetween;

a plurality of blades having generally complementarily shaped dovetails disposed in said dovetail slots; and rolling contact means disposed in said slots between said dovetails and said disk posts for providing rolling contact therebetween, said rolling contact means comprising:

at least one contoured pin having predetermined radial and axial contours disposed in a nest suitably geometrically configured to retain said pin, wherein said predetermined radial contour of said contoured pin varies as a function of axial length of said pin, such that a pin radius R has a minimum value proximate first and second ends of said pin and a maximum value proximate an axial midpoint of said pin, varying substantially uniformly and smoothly therebetween; and wherein said next comprises:

a first curved seating surface of said post having first predetermined axial length, arcuate contour, arcuate length and angular orientation, wherein said first arcuate contour of said first curved seating surface of said post has a first radius of curvature $R_P$ which is substantially constant along said axial length thereof; and a second curved seating surface of said dovetail having second predetermined axial length, arcuate contour, arcuate length and angular orientation, wherein said second arcuate contour of said second curved seating surface of said dovetail has a second radius of curvature $R_D$ which is substantially constant along said axial length thereof.

11. The invention according to claim 10 wherein said contoured pin comprises a hollow annular shell.

* * * * *